United States Patent [19]

Sarnosky et al.

[11] Patent Number: 5,062,410

[45] Date of Patent: Nov. 5, 1991

[54] DOWNDRAFT RANGE VENTILATOR

[75] Inventors: Joseph R. Sarnosky, Fort Atkinson; David W. Wolbrink, Hartford; Alan G. Klug, Mequon; Gary E. Behm, West Bend, all of Wis.

[73] Assignee: Broan Mfg. Co., Inc., Hartford, Wis.

[21] Appl. No.: 556,843

[22] Filed: Jul. 23, 1990

[51] Int. Cl.[5] ..... F24C 15/20

[52] U.S. Cl. ..... 126/299 D; 126/299 R; 98/115.4; 49/375; 49/349

[58] Field of Search ..... 126/299 R, 300, 21 R, 126/301, 302, 303, 214 A, 299 D; 98/41 R, 36; 49/131-134, 49

[56] References Cited

U.S. PATENT DOCUMENTS

| | | | |
|---|---|---|---|
| 3,011,492 | 12/1961 | Humbert . | |
| 3,409,005 | 11/1968 | Field . | |
| 3,474,724 | 10/1969 | Jenn . | |
| 3,596,650 | 8/1971 | Cerola . | |
| 3,712,819 | 1/1973 | Field . | |
| 4,446,849 | 5/1984 | McFarland . | |
| 4,501,260 | 2/1985 | Grace . | |
| 4,889,104 | 12/1989 | Gastelow | 126/299 R |
| 4,934,337 | 6/1990 | Falk | 126/299 R |
| 4,945,891 | 8/1990 | Cecil | 126/299 R X |

*Primary Examiner*—Larry Jones

*Attorney, Agent, or Firm*—Andrus, Sceales, Starke & Sawall

[57] ABSTRACT

A ventilator for a cooking unit located in a counter has a housing suitable for mounting beneath the counter. A vent member moves in a generally vertical direction with respect to the housing between a retracted position in which said vent member is flush with the counter and an extended position in which the vent extends above the counter adjacent to the cooking unit. The vent member is in fluid communication with said housing. A blower is coupled to said housing for drawing cooking effluents produced at the cooking unit into said vent member, downwardly through said vent member into said housing, and discharging same from said ventilator. A motor is mounted on the housing for moving a roller in an arcuate path. The roller engages a follower surface mounted on the vent such that travel of the roller along the follower surface drives the vent to the extended position. The vent moves to the retracted position by its own weight, with such movement being restrained by the engagement between the roller and the drive surface.

18 Claims, 5 Drawing Sheets

FIG. 1a
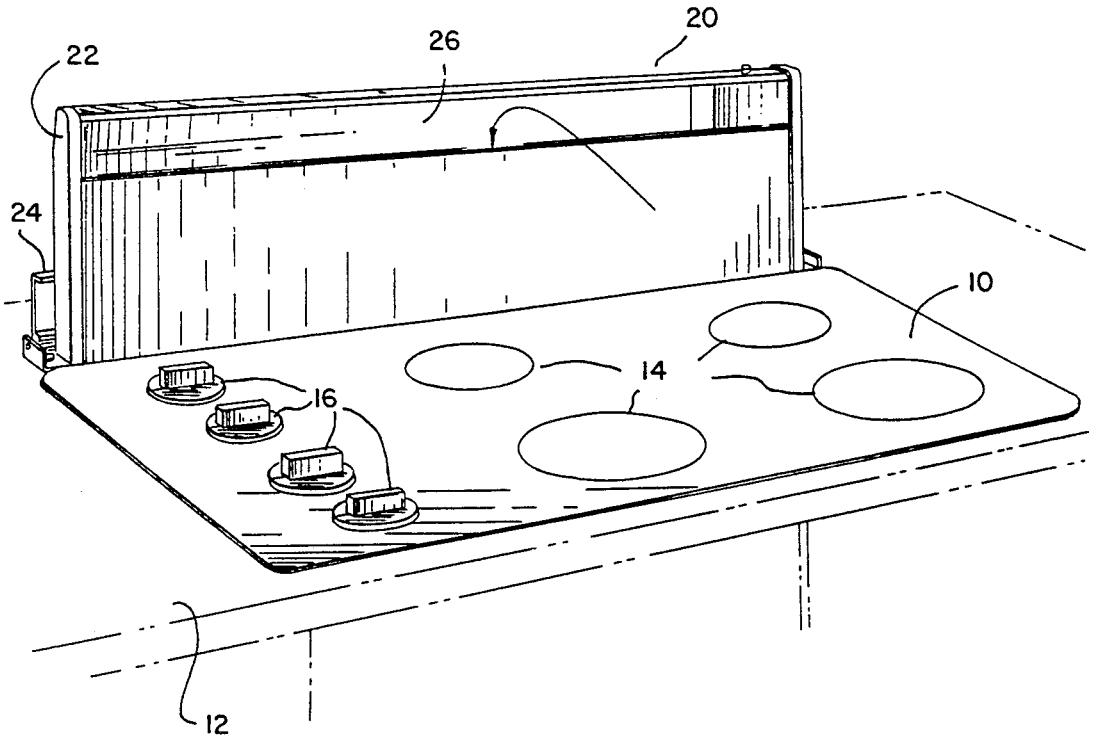
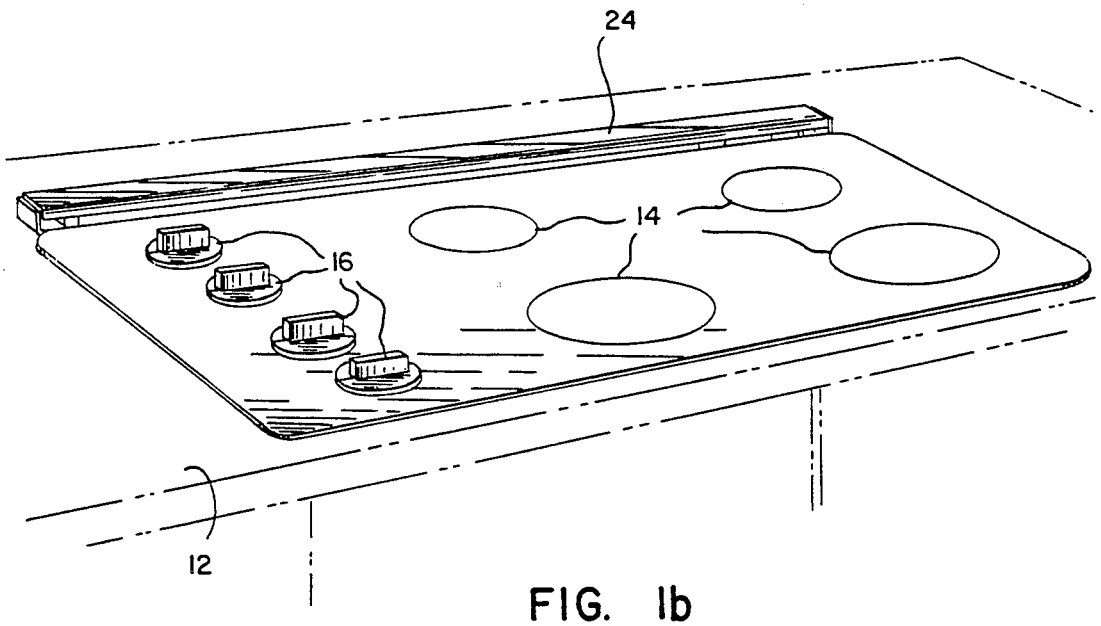
FIG. 1b

FIG. 2
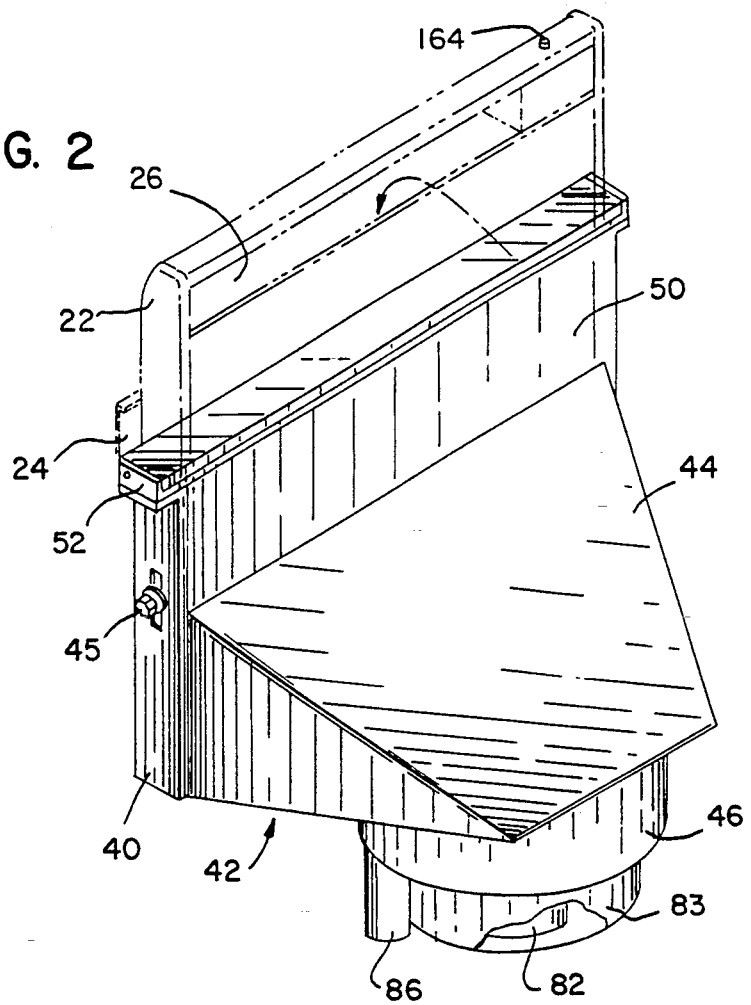
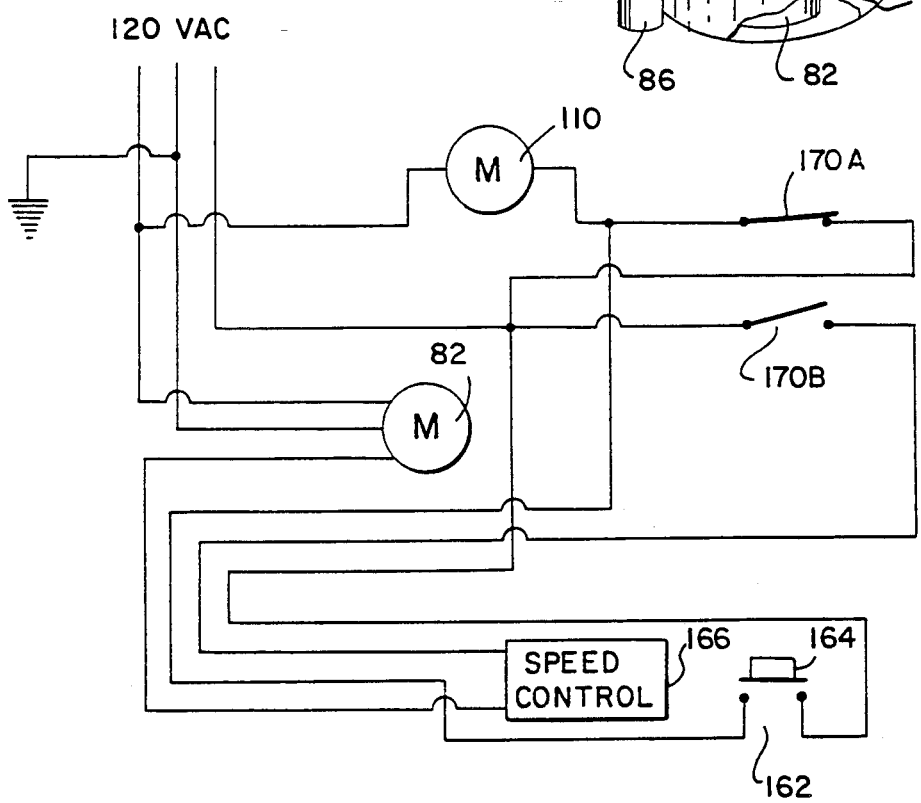
FIG. 5

DOWNDRAFT RANGE VENTILATOR

BACKGROUND OF THE INVENTION

1. Field of the Invention

The present invention relates to a ventilator for a cooking unit. The, cooking unit may typically comprise a range, grill, broiler, fryer, or the like. The ventilator draws off cooking effluents such as smoke, steam, grease spatters, and burnt food particles produced at the cooking unit so as to prevent their being carried to other parts of the kitchen or cooking area. More particularly, the present invention relates to a cooking unit ventilator having a vent that is extendible from, and retractable into, the surface or counter surrounding the cooking unit. The ventilator removes cooking effluents from the cooking unit in a downwardly direction.

2. Description of the Related Art

Numerous techniques have been devised for providing ventilation to cooking units of the type noted above. For example, a hood may be positioned over the cooking unit to draw off the cooking effluents. Range hoods provide highly effective ventilation since their positioning above the cooking unit complements the convective movement of much of the cooking effluent. However, their size and their location over the cooking unit is often less than aesthetically satisfactory in applications such as domestic kitchens. This is particularly true where the cooking unit is mounted in a separate island or in a portion of the counter extending in a peninsular fashion into the kitchen.

Another approach is to mount the ventilator in, or beside, the cooking unit so that the opening receiving the cooking effluents is generally flush with the surface of the cooking unit. See, for example, the numerous patents assigned on their faces to the Jenn-Aire Corporation of Indianapolis, Ind. of which U.S. Pat. No. 3,596,650 and 3,474,724 are typical. Cooking unit ventilators of this type possess the advantages of compactness and aesthetic appeal.

However, flush mounted ventilators may possess one or more of the following disadvantages. When a gas flame is employed in the cooking unit, the air movement produced along the upper surface of the cooking unit by the flush mounted ventilator may distort the flame. When a cooking utensil such as a pot is being used on the cooking unit, the most effective ventilation is occurring at the bottom of the pot, not the top of the pot where the cooking effluents are being generated. Further, when cooking is being done directly on a cooking unit, such as a grill, the flush mounted ventilator draws cool air over the food.

While some or all of these disadvantages can be overcome by raising the ventilator above the surface of the cooking unit, this lessens the attractiveness of such a ventilator and its usefulness in environments such as domestic kitchens.

U.S. Pat. No. 4,501,260 shows a cook top ventilation system with an extendible-retractable vent. The vent can be retracted into the counter surrounding the cooking unit when not in use and can be extended above the cooking unit when ventilation is desired. The raised entry increases the effectiveness of the ventilation provided to the cooking unit and avoids distorting a gas flame and drawing cold air over the food.

However, the cook top ventilation system shown in the '260 patent has a motor driven crank-type raising and lowering mechanism stabilized by a cross bar linkage. This is mechanically complex, adding to the cost of the system and propensity for breakdown. There is the possibility for injury or damage during retraction of the vent. The configuration of the vent, or nozzle, that extends above the cooking surface reduces the efficiency of the ventilation.

Another known ventilator of this type utilizes a rack and pinion type mechanism for raising and lowering the vent. The pinion is mounted on the output shaft of the drive motor and the rack is in the form of an open wound spring that is connected to the vent. This unit is also mechanically complex requiring, for example, a reversible drive motor. U.S. Pat. No. 4,889,104 shows a ventilator of this type.

SUMMARY OF THE INVENTION

The present invention is, therefore, directed to an improved ventilator of the type having a vent that is extendible from, and retractable into, the surface of the counter surrounding the cooking unit. The downdraft range ventilator of the present invention has an improved raising and lowering mechanism that is simple and economical in construction, and less hazardous in operation in certain respects.

The ventilator possesses an aerodynamic vent that lends efficiency to the ventilator and permits an efficient sizing of the portions extending above the countertop. The exposed portions of the ventilator are further constructed in a manner that provides a highly aesthetic appearance and permits the decor of such portions to be changed to match that of a particular kitchen. The extendible vent is covered by a door, when retracted to further enhance the aesthetic aspects of the ventilator. The door may be used to actuate the control circuit for raising the vent. The exposed portions may be easily replaced if damaged.

The discharge duct leading from the unit may be connected in a plurality of positions, thus lending flexibility in the installation of the unit.

Briefly, the present invention contemplates a ventilator for drawing off cooking effluents produced at a cooking unit located in a generally horizontal surface, such as a counter. The ventilator has a housing for mounting beneath the surface containing the cooking unit. A vent has an opening in the upper portion. The vent is movable in a generally vertical direction between a retracted position in which said vent member lies generally flush with the surface and extended position in which the vent extends above the surface adjacent to the cooking unit. The vent is in fluid communication with the housing and the ventilator has a blower coupled to the housing for drawing cooking effluents from the cooking unit into the vent through the opening, downwardly through the vent into the housing, and discharging same from the ventilator.

A particular aspect of the present invention comprises the means for moving the vent between the retracted and extended positions. The means includes a motive power means, such as a gear motor. A drive means, for example a roller, is coupled to the motor for being moved in a path having a vertical motion component. The path is typically an arcuate path. A cam follower means is mounted on said vent member and has a follower surface engaging said drive means in a manner such that travel of the roller along the follower surface drives the vent member upwardly to the extended position as a result of the component of vertical motion of the drive means. The engagement of the follower surface and roller controls the return of the vent member downwardly to the retracted position. More specifically, the engagement between the follower surface and roller is such that the vent member moves to the retracted position by its own weight and the drive means restrains the downward movement of the vent to the retracted position.

The follower surface of the cam follower means may be generally normal to the vertical movement of said vent member and comprise a generally planar surface. Or, the follower surface may lie at an angle to the direction of vertical movement of said vent member. The follower surface may have one or more curved portions to impart desired characteristics to the movement of the vent.

The vent may be mounted on a carriage having ball bearing friction reducing means and movable on a track mounted on the housing to facilitate the movement provided to the vent by the drive means and cam follower means.

The housing of the ventilator is so constructed that the blower can be coupled to said housing in a plurality of positions for altering the direction in which the cooking effluents are discharged from said ventilator.

The vent is aerodynamically formed to facilitate the flow of cooking effluents through said vent and the ventilator includes a door for covering said vent member when said vent member is in the retracted position.

BRIEF DESCRIPTION OF THE DRAWING

The present invention will be further appreciated by reference to the following detailed description, taken in conjunction with the accompanying drawing, in which:

FIG. 1A is a perspective view of the downdraft ventilator of the present invention with the vent in the extended position;

FIG. 1B is a perspective view, similar to FIG. 1A, but showing the vent in the retracted position;

FIG. 2 is a perspective view of the downdraft ventilator of the present invention;

FIG. 5 is a schematic diagram of the electrical circuit for the downdraft range ventilator of the present invention;

DESCRIPTION OF THE PREFERRED EMBODIMENT

Figure 3:
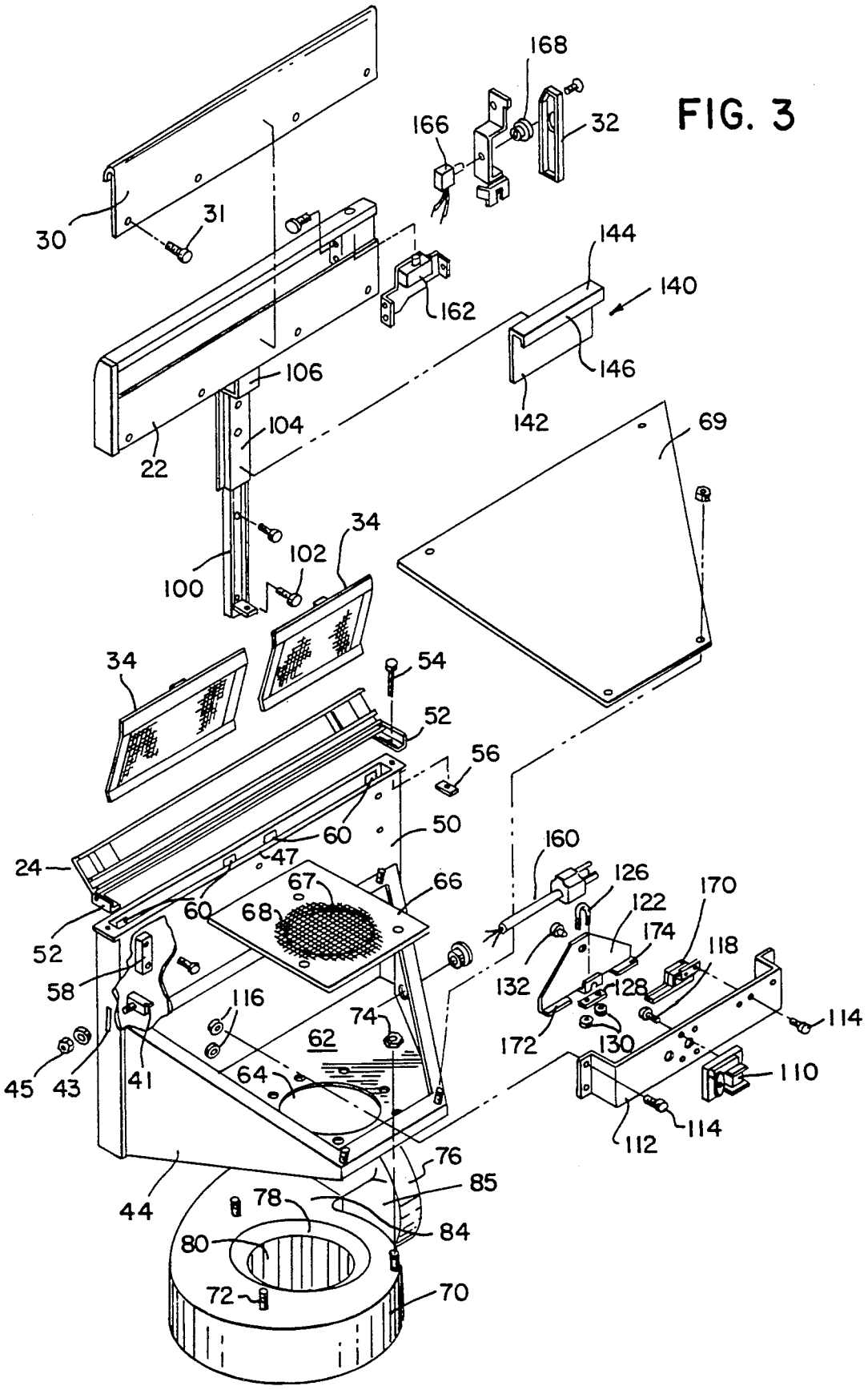
FIG. 3 is a detailed exploded view of the ventilator showing the elements thereof.

In FIG. 1, the numeral 10 indicates a cooking unit. Cooking unit 10 is typically mounted in counter 12 of a kitchen or other cooking area. For exemplary purposes, cooking unit 10 is shown with a plurality of burners 14, the temperature of which is established by controls 16. Cooking unit 10 may also contain other types of cooking elements, such as a grill, broiler, fryer, or the like.

To provide ventilation for cooking unit 10, downdraft range ventilator 20 is provided adjacent one edge thereof. Ventilator 20 includes vent 22 which can be extended above the surface of cooking unit 10 and counter 12 to draw off the effluents produced by the cooking carried out on burners 14. When not in use, vent 22 may be retracted and covered with door 24 thus lending a highly aesthetic appearance to the downdraft range ventilator, as well as to cooking unit 10.

The portions of ventilator 20 facing the cooking unit may be described herein as being to the "front" of the ventilator, with the rear, side, top and bottom portions taken accordingly.

As shown in FIGS. 1A and 2, vent 22 includes opening 26 extending along the front, upper portion thereof. The rear wall 28 of vent 22 lying directly behind opening 26 may be curved, as shown in FIG. 4, to lend an aerodynamic configuration to vent 22 that provides a highly efficient movement of air through vent 22 and advantageous proportioning of both vent 22 and opening 26. The front wall of vent 22 may contain a piece of removable trim (see FIG. 3) 30 that can be selected in accordance with the decor of cooking unit 10 or the kitchen. Trim 30 may be fastened to vent 22 by bolts 31. As shown most clearly in FIG. 4, one of the side walls 32 of vent 22 contains a control, hereinafter described, for adjusting the speed of the blower employed in the ventilator. The bottom of vent 22 is open to permit the passage of cooking effluents entering through opening 26 out of vent 22.

As shown most clearly in FIGS. 3 and 4, vent 22 includes a pair of removable filters 34 lying across the passage formed in the duct. These filters remove grease from the cooking effluents before they pass through the remaining portions of downdraft range ventilator 20.

Vent 22 extends and retracts in sleeve 40 forming a portion of housing 42. Housing 42 also includes plenum 44 that couples vent 22 to blower 46.

Sleeve 40 is of parallelopipedal configuration. It is open at the top to receive vent 22 and open along the bottom portion of the front wall 50 to communicate with plenum 44. The back, side, and bottom walls of sleeve 40 are closed. Sleeve 40 includes brackets 52 on which door 24 is hinged. Brackets 52 may be mounted to sleeve 40 by bolts 54 and complementary threaded fasteners 56. By loosening brackets 50, door 24 may be removed and replaced with a door having a different decor, if desired.

Movement of vent 22 within sleeve 40 may be facilitated by spacer 58 and slide strips 60 mounted on the inside of the walls of sleeve 40. The spacer and slide strips 60 may be formed of nylon or other suitable lubricious material.

Sleeve 40 contains stops 41 for supporting vent 22 when it is in the retracted position. Each stop 41 extends through slot 43 in sleeve 40 and is fastened to sleeve 40 by an appropriate fastener such as nut 45. The position of stops 41 in sleeve 40 can be adjusted to alter the position of vent 22 within sleeve 40 when the former is in the retracted position.

A stop corresponding to stop 41 is provided on the opposing side wall of sleeve 40.

The front edge 47 of sleeve 40 may be used to support the rear edge of the cooking unit when both are placed in a common opening in counter 12, thereby facilitating the installation of the cooking unit.

As shown in FIGS. 2 and 3, plenum 44 may be generally wedge-shaped in configuration. The rear of the wedge-shaped configuration of plenum 44 is open to communicate with sleeve 40. The lower wall 62 contains opening 64 for communicating with blower 46. Venturi plate 66 positioned on lower wall 62 contains venturi 67 alignable with opening 64. Venturi 67 is covered with screen 68.

Upper wall 69 of plenum 44 is removable to permit access to the plenum.

Blower 46 is mounted beneath lower wall 62 of plenum 44. Blower 46 includes a scroll-like shroud 70. Shroud 70 contains studs 72 that extend through holes in lower wall 62 for retaining the shroud on lower wall 62 by means of nuts 74. Venturi plate 66 is placed on lower wall 62 so that studs 72 extend through corresponding holes in the venturi plate so that it can be affixed to the lower wall 62 when nuts 74 are threaded on studs 72 to abut the upper surface of venturi plate 66. A plurality of holes are placed around the periphery of opening 64. This permits blower 46 to be positioned so that the discharge port 76 can be oriented in a variety of positions with respect to downdraft range ventilator 22, as hereinafter described.

Shroud 70 includes centrally located inlet opening 78 that is aligned with the venturi 67 to form an air passage between plenum 42 and blower 46. Shroud 70 contains centrifugal impeller 80. As shown most clearly in FIG. 2, impeller 80 is driven by a motor 82 contained in protective cover 83. Shroud 70 also contains discharge passage 84 on the periphery thereof. Discharge passage 84 has adaptor 85 that permits the discharge port 76 to be connected to a tubular duct for carrying off the discharge from downdraft range ventilator 20.

If desired, a container 86 may be mounted on the lower surface of housing 70 to collect grease and other materials contained in the air passing through blower 46.

Because of the holes placed around the periphery of opening 64, blower 46 and discharge port 76 can be oriented in the position shown in FIG. 3, in a position rotated approximately 90° with respect to the position shown in FIG. 3, or rotated approximately 180° with respect to the position shown in FIG. 3. The plurality of discharge positions provide a high degree of flexibility in the installation of downdraft range ventilator 20 under counter 12. Venturi plate 66 may also be rotated as blower 46 and discharge port 76 are rotated.

For moving vent 22 between the extended and retracted positions, track 100 is mounted on the rear wall of sleeve 40, as by means of fasteners 102. Track 100 may be mounted in the center of the rear wall of sleeve 40. Carriage 104 mounted to vent 22 by bracket 106 rides on track 100.

Figure 6:
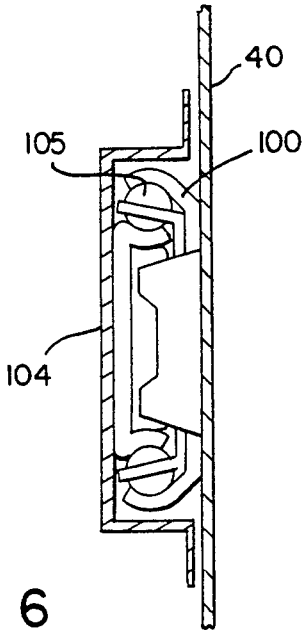
FIG. 6 is a cross-sectional view showing the carriage and track elements used for moving the vent of the ventilator.

To facilitate the movement of vent 22 between the extended and retracted positions, carriage 104 is fastened to an element containing a plurality of ball bearings 105 held in the element so that the surfaces of the ball ride on track 100, as shown in FIG. 6. This provides low friction to the movement of vent 22. It has been found that a single such track and guide is capable of providing the requisite extension and retraction movement of vent 22 without the need for additional guide or stabilizing apparatus.

The mechanism for raising and lowering vent 22 is shown in FIGS. 3 and 4. The mechanism is powered by motor 110. Motor 110 is mounted on bracket 112 fixed by fasteners 114 to nuts 116 stud welded to the rear wall of sleeve 40. Motor 110 is affixed to bracket 112 by bolts 118. The output shaft 120 of motor 110 extends through bracket 112, as shown most clearly in FIG. 4. Motor 110 preferably includes gearing for reducing the speed of the output shaft to that suitable for moving vent 22.

Plate 122 is fastened to output shaft 120 to rotate therewith. For this purpose, plate 122 may have U-shaped flange 124 along one edge thereof. A hole in flange 124 and in plate 122 permits shaft 120 to extend through the flange and plate. U bolt 126 clamps shaft to plate 122 by means of backing plate 128 and nuts 130.

Roller 132 is mounted on plate 122 at a position spaced from shaft 120. Roller 132 may comprise a nylon tire 134 mounted on wheel 136 that rotates on axle 138 press fitted or otherwise fixed to plate 122.

Cam follower 140, driven by roller 132 is mounted on carriage 104 fastened to vent 22. Cam follower 140 includes back plate 142 that is affixed to the carriage. Cam follower 140 also includes follower surface 144 that contacts roller 132, in the manner shown in FIGS. 4 and 7. A retaining lip 146 assists in retaining roller 132 in contact with cam follower 140.

Figure 4A:
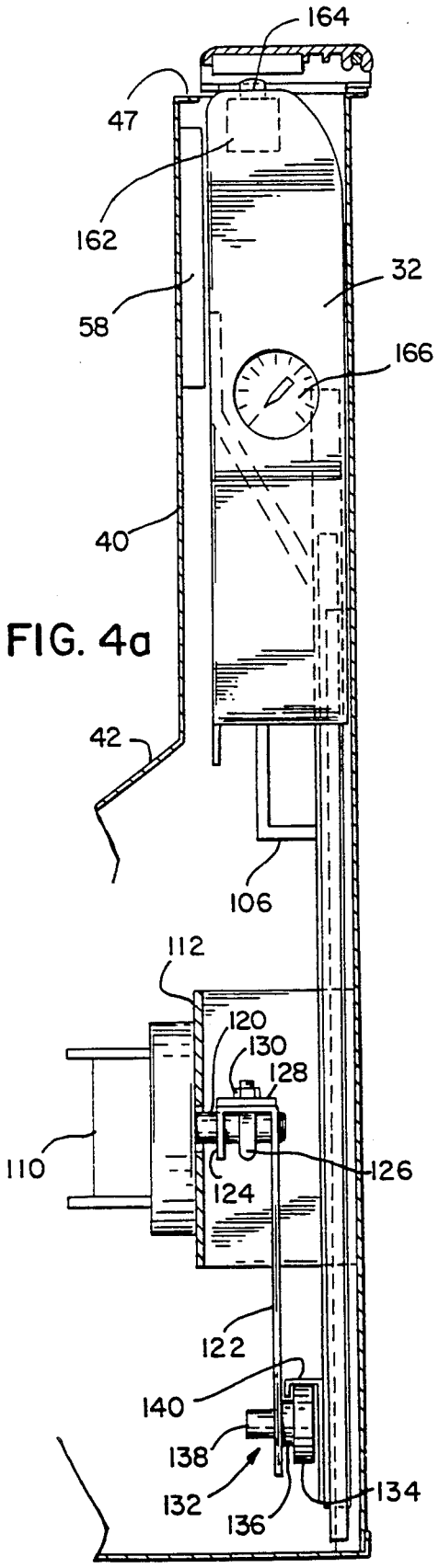
FIG. 4A is a cross-sectional view showing the mechanism for raising and lowering the vent, with the vent in the lowered position.

The control circuit for motor 110 that raises and lowers duct 22, as well as motor 82 for blower 46 is shown in FIG. 5. The circuitry may be energized by line voltage obtained through power cord 160. Normally open switch 162 is mounted in vent 22 so that the operating element 164 thereof extends above the upper surface of vent 22. As shown in FIG. 4A, this permits the operation of downdraft range ventilator 20 to be initiated by pressing on the upper surface of door 24, that in turn presses on operative element 164 to close switch 162. As noted above, speed control 166 for blower motor 82 is mounted in end wall 32 of vent 22. Speed control 166 is operated by knob 168.

Switch 170 is mounted on bracket 112 so as to be operated by movement of plate 122. To this end, switch means 170 may be actuated by flanges 172 and 174 contained on the edge of plate 122 to which motor shaft 120 is affixed. Switch means 170 contains normally closed switch 170A and normally open switch 170B. Flanges 172 and 174 extend from plate 122 by different amounts to carry out the desired switching action of switch means 170, as hereinafter described. Flange 172 may extend from plate 122 a lesser amount than flange 174.

The operation of downdraft range ventilator 20 is as follows. With vent 22 in the retracted position shown in FIG. 4A, plate 122 is in a position such that shorter flange 172 actuates switch 170A but does not actuate switch 170B. Flange 172 opens normally closed switch 170A. Normally open switch 170B remains open. Both motor 110 and blower motor 82 are de-energized.

To raise vent 22 from the retracted position, door 24 is depressed with finger pressure to depress operating element 164 of switch 162 to close the switch. The closure of switch 162 energizes motor 110. The energization of motor 110 causes plate 122 containing roller 132 to rotate from the position shown in FIG. 4A. The rotation of plate 122 carries roller 132 in an arcuately upward direction.

Roller 132, engaging cam follower 144, causes a corresponding upward movement of carriage 104 and vent 22.

The rotation of plate 122 moves flange 172 out of engagement with switch 170A, allowing this switch to assume its normally closed position. This maintains the energization of motor 110 when operating element 164 of switch 162 is released.

Figure 4B:
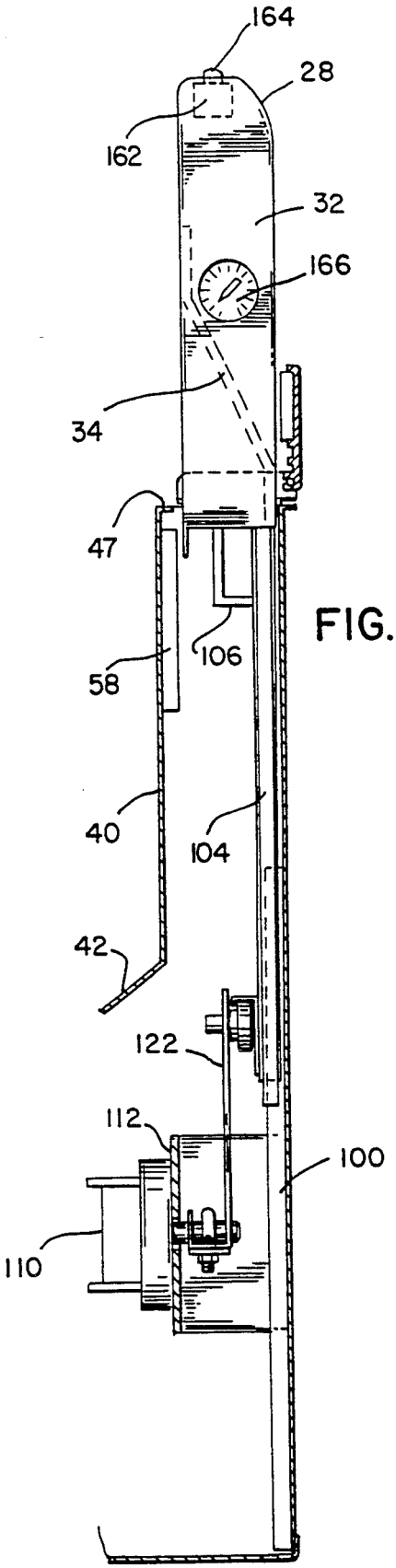
FIG. 4B is a cross-sectional view similar to FIG. 4A showing the mechanism for raising and lowering the vent in the raised position.

The arcuately upward movement of plate 22 and roller 132 continues until the elements reach or approach the position shown in FIG. 4B. Carriage 104, driven by roller 132, moves vent 22 to the extended position shown in FIG. 4B. At this point, plate 122 will have rotated approximately 180°. Larger flange 174 now engages both switches 170A and 170B. The engagement with switch 170A opens this switch to de-energize motor 110 so that vent 22 remains in the extended position. At the same time, switch 170B is closed to energize blower motor 82 to draw air and cooking effluents into opening 26 of vent 22. The speed of blower motor 82 can be controlled by speed control 166 mounted within end plate 32 of vent 22.

To retract vent 22, switch 162 is again actuated by pressing operating element 164. This energizes motor 110 to cause plate 122 to rotate. In the embodiment of the invention shown and described herein, the direction of rotation of plate 122 during retraction of vent 22 will be the same as the direction of rotation occurring during the extension of the vent. This avoids the need for a reversible motor 110.

The rotation of plate 122 will cause roller 132 to move in an arcuately downward direction. This will enable vent 22 to move downwardly under the force of its own weight along track 100, the downward movement being restrained by the contact between roller 132 and cam follower 140.

The rotation of plate 122 will move flange 174 out of engagement with switch means 170, causing switch 170A to resume the normally closed condition and switch 170B to resume the normally open condition. The closure of switch 170A allows motor 110 to remain energized when operating element 164 of switch 162 is released. The opening of switch 170B de-energizes blower motor 82 to terminate the ventilating action.

When plate 122 and roller 132 return to the retracted position shown in FIG. 4A, flange 172 will reengage switch 170A to open the switch. This de-energizes motor 110. Downdraft range ventilator 20 is then ready for another extension and retraction operation.

During the retraction of vent 22, downdraft range ventilator 20 operates in a manner that tends to reduce the hazards found in ventilation systems such as that shown in U.S. Pat. No. 4,501,260 in which the vent is drivingly retracted. As described above, vent 22 is not driven by motor 110 for movement in the downwardly direction. Rather, it is lowered by the force of its own weight under the influence of gravity. Since vent 22 is not driven in the downwardly direction, should fingers or a pot handle be inserted into opening 26 during the retraction of vent 22, the maximum force will be the weight of vent 22. The downward movement of vent 22 is restrained by the coaction of roller 132 with cam follower 140 to limit the rapidity with which vent 22 moves in the downwardly direction.

The lack of a fixed connection between roller 132 and cam follower 140 also facilitates adjustment of stops 41 and the positioning of vent 22. It also facilitates the removal of vent 22 for replacement or repair.

The roller 132, cam follower 140 mechanism described above, provides characteristics deemed highly desirable to the motion of vent 22. The characteristics so provided may resemble the linear motion properties of sinusoidal movement, i.e. vent 22 moves more slowly at the beginning and end of its motion and more rapidly during the middle of its motion.

Figure 7A:
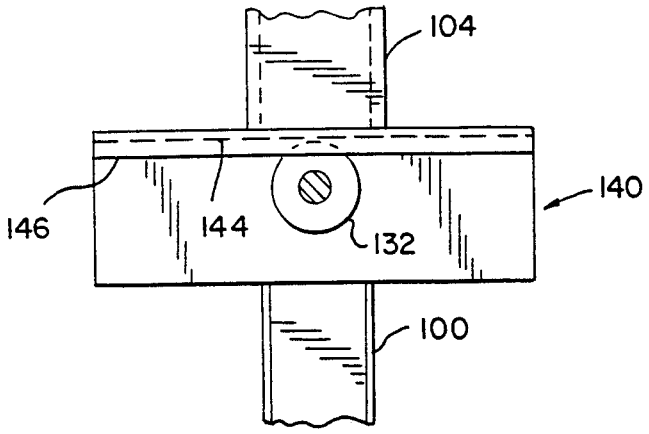
FIGS. 7A, 7B, and 7C show various embodiments of the cam follower element for moving the vent of the ventilator.
Figure 7B:
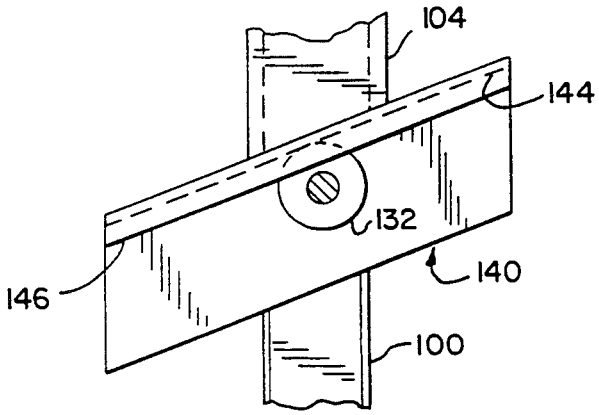
Figure 7C:
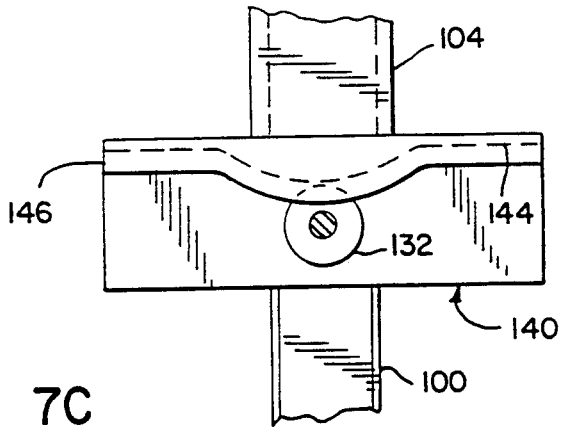

The roller 132-cam follower 140 mechanism employed in the present invention permits the amount and characteristics of the movement of vent 22 to be easily changed, if desired. While FIGS. 3, 4, and 7A show cam follower surface 144 lying normal to the direction of movement of vent 22, it will be appreciated that the surface may lie at some other angle with respect to the direction of movement, as shown in FIG. 7B. Further, while the cam follower surface 144 is shown as flat in FIGS. 3, 4, 7A and 7B, it will be appreciated that a curved cam follower surface could be utilized to provide desired movement amounts and characteristics to the extension and retraction of vent 22, as shown in FIG. 7C. For example, the cam follower surface may be formed in a manner that causes the final portion of the downward movement to occur very slowly, thereby to lessen the likelihood that a finger could be pinched as vent 22 retracts into counter 12. Similarly, the initial portions of the upward movement could occur very rapidly, if desired.

Various modes of carrying out the invention are contemplated as being within the scope of the following claims particularly pointing out and distinctly claiming the subject matter which is regarded as the invention.

We claim:

1. A ventilator for drawing off cooking effluents produced at a cooking unit positioned in a generally horizontal surface, the ventilator comprising:

a housing suitable for mounting beneath the surface in which the cooking unit is positioned;

a vent member having an opening through which the cooking effluents may be drawn off, said vent member being movable in a generally vertical direction between a retracted position in which said vent member is proximate the surface and an extended position in which the vent extends above the surface adjacent to the cooking unit, said vent member being in fluid communication with said housing, at least when said vent member is in the extended position;

a blower coupled to said housing for drawing the cooking effluents into said opening in said vent member, downwardly through said vent member into said housing, and discharging same from said ventilator; and means for moving said vent member between the retracted and extended positions, said means having;

follower means mounted on said vent member and having a follower surface;

motive power means; and drive means coupled to, and movable by, said motive power means, said drive means having a drive portion engaging said follower surface and displaceable therealong, said drive portion being moved by said motive power means in an arcuate path in a plane generally parallel to the direction of movement of said vent member between said extended and retracted positions so as to have a vertical component of motion, displacement of said drive portion along said follower surface upon movement of said drive means driving said vent member upwardly to the extended position as a result of the vertical component of motion of said drive portion, the engagement of said follower surface and said drive portion controlling the return of said vent member downwardly to the retracted position.

2. The ventilator according to claim 1 wherein the engagement between said follower surface and drive portion is such that the force moving said vent member to the retracted position is that of the weight of said vent member and that the drive means restrains the downward movement of said vent member to the retracted position.

3. The ventilator according to claim 1 wherein said drive portion comprises a roller.

4. The ventilator according to claim 1 wherein said follower surface lies at an angle of approximately 90° to the direction of vertical movement of said vent member.

5. The apparatus according to claim 1 wherein said follower surface comprises a generally planar surface.

6. The ventilator according to claim 4 wherein said follower surface comprises a generally planar surface.

7. The ventilator according to claim 1 wherein said follower surface lies at an angle other than 90° to the direction of vertical movement of said vent member.

8. The ventilator according to claim 7 wherein said follower surface comprises a generally planar surface.

9. The ventilator according to claim 1 wherein said follower surface has a curved portion.

10. The ventilator according to claim 1 wherein said vent member is mounted on a carriage movable on a track mounted on said housing.

11. The ventilator according to claim 10 wherein said carriage includes means for reducing the friction between the carriage and the track.

12. The ventilator according to claim 11 wherein said carriage contains ball bearing friction reducing means.

13. The ventilator according to claim 1 wherein said blower is so coupled to said housing as to be locatable in a plurality of positions with respect to said housing for altering the direction in which the cooking effluents are discharged from said ventilator.

14. The ventilator according to claim 1 wherein said vent member is aerodynamically formed to facilitate the flow of cooking effluents through said vent member.

15. The ventilator according to claim 14 wherein said vent member has a first wall with said opening, said vent member having a second wall opposing said first wall, said second wall being curved in the portion opposing said opening to facilitate the flow of cooking effluents through said vent member.

16. The ventilator according to claim 1 wherein said ventilator includes a door for covering said vent member when said vent member is in the retracted position.

17. The ventilator according to claim 16 further including switch means for operating said motive power means, said switch means being mounted on said vent for being operable by pressure applied to said door when said vent member is in the retracted position.

18. A ventilator for drawing off cooking effluents produced at a cooking unit positioned in a generally horizontal surface, the ventilator comprising:

a housing suitable for mounting beneath the surface in which the cooking unit is positioned;

a vent member having an opening through which the cooking effluents may be drawn off, said vent member being movable in a generally vertical direction between a retracted position in which said vent member lies below the surface and an extended position in which the vent extends above the surface adjacent to the cooking unit, said vent member being in fluid communication with said housing, at least when said vent member is in the extended position;

a blower coupled to said housing for drawing the cooking effluents into said opening in said vent member, downwardly through said vent member into said housing, and discharging same from said ventilator; and means for moving said vent member between the retracted and extended positions, said means having;

follower means mounted on said vent member and having a planar follower surface lying generally normal to the direction of vertical movement of said vent member;

rotary motive power means; and drive means coupled to, and movable by, said motive power means, said drive means having a roller engaging said follower surface and displaceable therealong, said roller being moved by said motive power means in an arcuate path in a plane generally parallel to the direction of movement of said vent member between said extended and retracted positions so as to have a vertical component of motion, displacement of said roller along said follower surface upon movement of said drive means driving said vent member upwardly to the extended position as a result of the component of vertical motion of said roller, the engagement of said follower surface and said roller further being such that the force moving said vent member to the retracted position is that of the weight of said vent member and that the roller restrains the downward movement of said vent member to the retracted position as a result of its vertical motion component.

* * * * *